US005142885A

United States Patent [19]

Utter et al.

[11] Patent Number: 5,142,885

[45] Date of Patent: Sep. 1, 1992

[54] METHOD AND APPARATUS FOR ENHANCED SCROLL STABILITY IN A CO-ROTATIONAL SCROLL

[75] Inventors: Robert E. Utter, Whitehouse, Tex.; Daniel R. Crum, La Crosse, Wis.

[73] Assignee: American Standard Inc., New York, N.Y.

[21] Appl. No.: 688,642

[22] Filed: Apr. 19, 1991

[51] Int. Cl.[5] ..... F01C 1/04

[52] U.S. Cl. ..... 62/498; 418/1; 418/55.1; 418/151

[58] Field of Search ..... 418/1, 51.1, 51.2, 151, 418/188; 62/498

[56] References Cited

U.S. PATENT DOCUMENTS 4,735,559 4/1988 Morishita et al. ..... 418/151
4,928,503 5/1990 Riffe ..... 62/498
5,013,226 5/1991 Nishida ..... 418/55.1

*Primary Examiner*—John J. Vrablik
*Attorney, Agent, or Firm*—William J. Beres; William O'Driscoll; David L. Polsley

[57] ABSTRACT

In a co-rotational scroll apparatus having two interleaving scroll wraps secured to end plates rotating about parallel, non-aligned axes to produce a relative orbital motion, a mass secured to at least one of the scrolls for enhancing the nutational stability of the scroll member. Preferably, the nutation reducing means includes a mass affixed to an end plate of the scroll member to induce a dynamic imbalance during rotation of the scroll member, creating a balancing or moderating moment sufficient to compensate for the moment induced by the varying pressure of the fluids in the various compression chambers during the rotation of the scroll member.

41 Claims, 4 Drawing Sheets

METHOD AND APPARATUS FOR ENHANCED SCROLL STABILITY IN A CO-ROTATIONAL SCROLL

TECHNICAL FIELD

This invention generally pertains to scroll apparatus and specifically to co-rotating scroll-type fluid apparatus having means for enhancing the stability of one or more of the rotating scroll members.

BACKGROUND ART

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radially exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to relative non-rotational motion. The general principles of scroll wrap generation and operation are discussed in numerous patents, such as U.S. Pat. No. 801,182.

Numerous attempts have been made to develop co-rotational scroll apparatus. Such apparatus provides for concurrent rotary motion of both scroll wraps on parallel, offset axis to generate the requisite orbital motion between the respective scroll wrap elements. However, most commercially successful scroll apparatus to date have been of the fixed scroll-orbiting scroll type due to various difficulties in achieving success with co-rotating scroll apparatus.

Typically, a number of rotary bearings are required in a co-rotational scroll apparatus, which decreases the reliability and efficiency of the machine. Furthermore, the typical co-rotating scroll apparatus have required a thrust bearing acting upon each of the scroll end plates to prevent axial scroll separation, thus substantially increasing the power requirements of the machine as well as substantially reducing the reliability of the machine.

An additional problem which must be dealt with in scroll apparatus, whether used for compression or decompression of fluid, are the forces which result from the fluid trapped in the chambers formed in the scroll wraps. These forces include an axial separation force component resulting from the fluid pressure upon the scroll element end plates and a radial separation force resulting from the fluid pressure upon the scroll wraps themselves. Furthermore, the separation forces due to the fluids compressed within the scroll elements vary cyclicly as the scroll elements rotate. This cyclic variation is a function of two factors. The first is the instantaneous location of each of the compression chambers formed by the scroll wraps during each revolution. The chamber location is a function of the angular and radial disposition of the center of the chamber with respect to the center of the scroll apparatus at a given crankangle. The second is the actual pressure of the compressed fluid, which varys according to the instantaneous location of the compression chamber in which the fluid is contained, decreasing from the radially inner ends of the respective scroll wraps to the radially outer ends thereof. Both these factors combine to produce a moment, the product of the instantaneous center of the compression chamber location and the instantaneous fluid pressure forces at that location. The resulting tipping moment upon the scroll member is the net effect of the moments developed by each compression chamber. The tipping moment acts perpendicularly to the axis of rotation of the scroll member, and therefore seeks to cause the tipping of the scroll element. Since the magnitude of the tipping moment is more pronounced at various crankangle positions during the rotation of the scroll element, actual tipping may occur at some crankangle positions, while it may be prevented at other positions by other forces sufficiently exerted on the scroll members. Actual tipping is observable as a rocking or nutation of the scroll member during rotation.

Typically, this is dealt with by the provision of an axial force acting to compress the end plates of the scroll elements together, in opposition to the separating fluid forces and by the provision of relatively larger bearings. These compressive axial forces are typically induced either mechanically by such means as thrust bearings or springs, or by fluid pressure imposed upon the opposite side of the scroll end plate.

Prior scroll apparatus attempt to counter the nutation effect by simply increasing the axial force loading upon the scroll end plate until the tipping moments are overcome, by providing a large number of bearings for supporting the scroll member shafts to prevent the shaft misalignment which occurs during tipping, and by decreasing the manufacturing tolerances of the components. All of these solutions increase the size and number of components of the scroll apparatus as well as the initial and operating costs, and also decrease the expected operating life of the scroll apparatus.

These solutions also undesirably affect the performance of the scroll apparatus as well. Because the axial force provided remains constant at any given operating condition, the axial force loading remains relatively high even when the separation effects of the tipping moment are low, which is typically the case during most of the scroll rotary cycle. Hence, there are unnecessarily high forces acting upon the scroll wrap tips at many crankangle positions in the scroll cycle, with resulting unnecessary friction and wear as well as excessive power consumption and loss of overall efficiency.

Furthermore, even when the axial force loading is relatively high, tipping of the scroll member can occur at some crankangle positions during rotation of the scroll apparatus. When nutation of the scroll element does occur, the scroll wrap tips can momentarily separate from the opposing scroll end plate. This permits fluid to pass from higher pressure compression chambers to lower pressure chambers, requiring recompression of the fluid and again reducing the overall efficiency of the scroll apparatus.

Therefore it is an object of the present invention to provide a scroll apparatus as will provide the highest possible efficiency while utilizing the least amount of power and therefore having the lowest power and least costly drive means.

It is a further object of the present invention to provide a method of reducing and compensating in a scroll apparatus at least in part for the net moment upon a rotating scroll member.

It is still a further object of the present invention to provide such a co-rotating scroll apparatus which is of simple construction and high operating reliability.

It is yet a further object of the present invention to provide a co-rotating scroll apparatus which is relatively compliant and not susceptible to damage in operation.

Finally, it is an object of the present invention to provide such a scroll apparatus as is suitable for and is relatively inexpensive in mass production.

SUMMARY OF THE INVENTION

The subject invention is a method and means for enhancing the rotational stability of at least one of the scroll members or elements in a co-rotational scroll apparatus having two concurrently rotating scroll members, each scroll member including an end plate and a scroll wrap thereon having at least an involute portion for interleaving engagement with the scroll wrap of the other scroll member and rotating on an axis parallel to the axis of the other scroll member.

Specifically, the subject invention includes a mass disposed on, or alternatively, a mass integral with the scroll end plate of at least one of the scroll members. This mass is disposed near the periphery or outer edge of the scroll end plate. The mass generates a moment which adds to the net effect of the moments generated by fluid forces within the scroll wraps, which is referred to as a tipping moment since tipping of the scroll member can result from the effect of this moment upon the scroll member. The mass is disposed so that the moment acting upon the scroll member as a result of the mass reduces or moderates the moment generated by other forces acting upon the scroll member during the rotation of the scroll member. This enhances the nutational stability of the scroll member during rotation, or in other words, reduces the rocking of the scroll member during rotation.

According to the method of the subject invention, the magnitude of the instantaneous moment resulting from fluid forces acting upon the scroll member, or tipping moment, is determined for each angular point or position throughout the rotation of the scroll member. From this, the maximum tipping moment acting upon the scroll member and the range of crankangle positions through which the maximum tipping moment acts can be found. The amount of mass, the radius or distance by which the mass is removed from the axis of rotation of the scroll member, and angular disposition of the mass necessary to induce a sufficiently moderating moment to moderate or reduce the maximum determined tipping moment is then also determined. The appropriate mass is then applied to the scroll member at the radius and angular disposition thus determined to reduce the nutation of the scroll member.

An exemplary co-rotational scroll apparatus which may suitably employ the subject invention is also presented.

DESCRIPTION OF THE PREFERRED EMBODIMENTS

Figure 1:
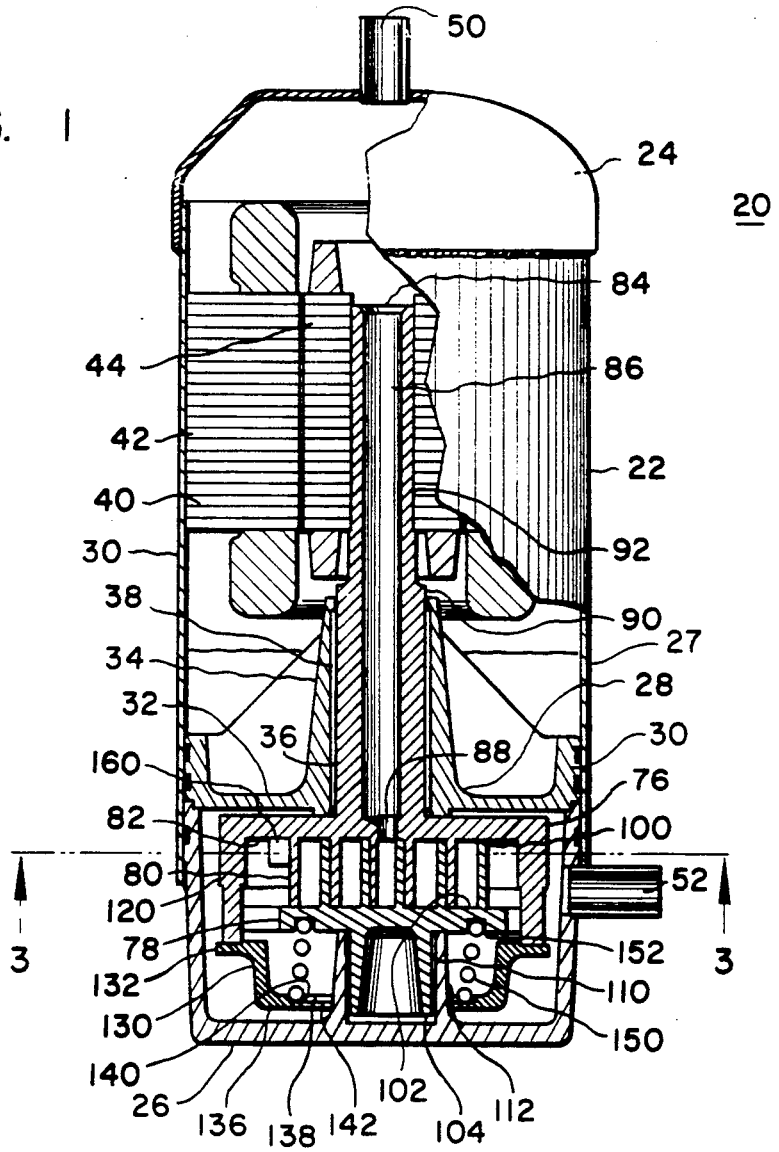
FIG. 1 discloses a cross-sectional view of a co-rotational scroll apparatus embodying the subject invention.

A scroll type fluid apparatus generally shown in FIG. 1 as a scroll compressor assembly is referred to as reference numeral 20. As the preferred embodiment of the subject invention is a hermetic scroll compressor assembly, the scroll apparatus 20 is interchangeably referred to as a scroll compressor 20 or as a compressor assembly 20. It will be readily apparent that the features of the subject invention will lend themselves equally readily to use in a scroll apparatus acting as a fluid expander, a fluid pump, or to scroll apparatus which are not of the hermetic type.

In the preferred embodiment, the compressor assembly 20 includes a hermetic shell 22 having an upper portion 24, a lower portion 26, a central exterior shell 27 extending between the upper portion 24 and lower portion 26, and an intermediate, central frame portion 28 affixed within the central exterior shell 27. The exterior shell 27 is a generally cylindrical body, while the central frame portion 28 is defined by a generally cylindrical or annular exterior portion 30 and a central portion 32 disposed across one end thereof. The annular exterior portion 30 of the central frame portion 28 is sized to sealingly fit within the exterior shell 27 so that it may be mated thereto by a press fit, by welding, or by other suitable means.

Integral with the central frame portion 28 is a generally cylindrical upper bearing housing 34, which is substantially coaxial with the axis of the annular exterior portion 30. A drive shaft aperture 36 extends axially through the center of the upper bearing housing 34, and an upper main bearing 38 is disposed radially within the drive shaft aperture 36. Preferably, the upper main bearing 38 is made, for example, of sintered bronze or similar material, but may also alternatively be a roller or ball-type bearing, for accepting a rotating load therein.

A motor 40 is disposed within the upper portion 24 and central shell portion 28 of the hermetic shell 22. The motor 40 is preferably a single-phase or three-phase electric motor comprised of a stator 42 which is circumferentially disposed about a rotor 44, with an annular space formed therebetween for permitting free rotation of the rotor 44 within the stator 42 as well as the flow of lubricant or refrigerant fluid.

It will be readily apparent to those skilled in the art that alternative types of motors 40 and means of mounting motor 40 would be equally suitable for application in the subject invention. For example the stator 42 could be secured within the central shell portion 27 by a press fit therebetween. Alternatively, a plurality of long bolts or cap screws (not shown) may be provided through appropriate apertures in the stator plates into threaded apertures in the central frame portion 28 for securing the motor 40 within the hermetic shell 22.

The scroll arrangement includes a first or drive scroll member 76 and a second or idler scroll member 78, each having an upstanding involute scroll wrap for interfitting engagement with the other respective scroll wraps. The first scroll member 76 includes an upstanding first involute scroll wrap 80 which is integral with a generally planar drive scroll end plate 82. The drive scroll end plate 82 includes a central drive shaft 84 extending oppositely the upstanding involute scroll wrap 80. A discharge gallery 86 is defined by bore extending centrally through the axis of the drive shaft 84. The discharge gallery 86 is in flow communication with a discharge aperture 88 defined by a generally central bore through the drive scroll end plate 82. The drive shaft 84 further includes a first, relatively large diameter portion 90 extending axially through the upper main bearing 38 for a free rotational fit therein, and a second relatively smaller diameter portion 92 which extends axially through the rotor 44 and is affixed thereto. The rotor 44 may be affixed to the rotor portion 92 of the drive shaft 84 by such means as a press fit therebetween or a power transmitting key in juxtaposed keyways.

The second or idler scroll member 78 includes a second, idler scroll wrap 100 which is disposed in interfitting contact with the driven scroll wrap 80. The idler scroll wrap 100 is an upstanding involute extending from an idler end plate 102. An idler stub shaft 104 extends from the idler end plate 102 oppositely the idler scroll wrap 100.

The designation of the drive scroll member 76 as the first scroll member and the idler scroll member 78 as the second scroll member must be understood as arbitrary, made for the purposes of ease of description and therefore not as a limitation. It would be equally accurate to designate the idler scroll member 78 as the first scroll member and the drive scroll member 76 as the second scroll member.

An annular bearing 110, which may be a sleeve bearing made of sintered bronze material, or may be of the roller or ball-type, is disposed within an annular wall defining an idler bearing housing 112 which is integral with the lower hermetic shell portion 26 as a support means for rotationally supporting the second or idler scroll member 78.

The first scroll end plate 82 also includes two extension members 120 extending from the first scroll end plate 82 parallel the drive scroll wrap 80. The extension members 120 are disposed at radially opposed positions near the outer edge of the first scroll end plate 82 and are of greater length than the height of the involute scroll wraps 80 and 100, respectively, plus the thickness of the second scroll end plate 102. The extension members 120 are affixed to an annular first scroll member compression plate 130. The compression plate 130 is generally cup shaped, having an annular generally planar circumferential portion 132 about the radial outward end thereof, to which the extension members 120 are affixed by such means as threaded fastener, welding or press fit. A depressed planar central portion 136 is parallel to and downwardly spaced a distance from the outer end portion 132 of the compression plate 130. This central portion 136 includes a second, slightly more downwardly spaced area describing an annular retaining shoulder 138 and a biasing surface 140. A central aperture 142 is described by a bore through the axial center of the depressed portion 136. The central aperture 142 is of substantially greater diameter than the lower bearing housing 112 so that there is sufficient clearance between the compression plate 130 and the lower bearing housing 112 to permit the compression plate 130 to rotate freely about the lower bearing housing 112.

A compression and drive spring 150 is disposed between the biasing surface 140 and the second scroll end plate 102. The compression spring 150 serves as a biasing means to force the respective scroll end plates 82 and 102 toward each other by exerting a force upon the second scroll end plate 102 and an opposite force upon the first scroll end plate 82 through the compression plate 130 and extension members 120. In the preferred embodiment, the spring 150 is retained within an annular channel 152 formed in the second scroll end plate 102. This permits the spring 150 also to act as a torque transmitting element. In this embodiment, the extension members, the compression plate 130 and the spring 150 together comprise a drive means for causing concurrent rotation of the first scroll member 76 and second scroll member 78.

Alternative drive means may include an Oldham-type ring driveably connecting the extension members 120 and drive keys on the idler scroll end plate 82. Since the form of drive means are not particularly relevant to the subject invention, no further detailed discussion thereof is deemed necessary herein.

Figure 2:
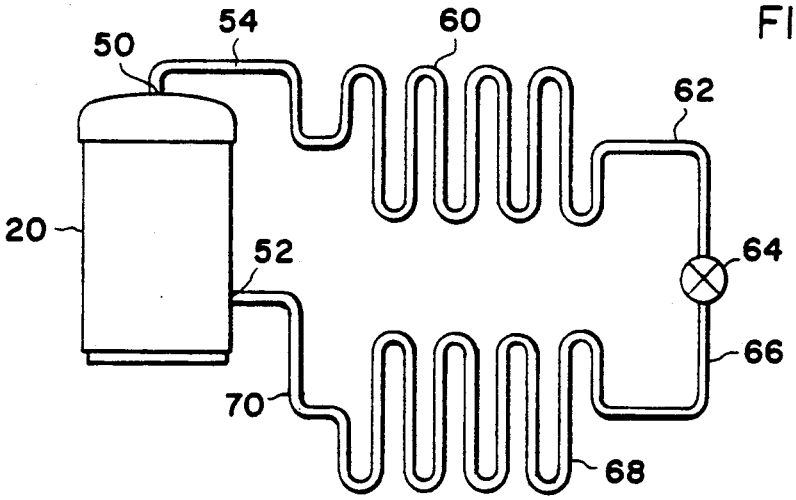
FIG. 2 discloses in schematic representation a refrigeration system in which the subject invention could be suitably employed.

In FIG. 2, the scroll compressor assembly 20 is shown connected at the discharge aperture 50 and the suction aperture 52 to a fluid system such as generally is used in refrigeration or air conditioning systems. Those skilled in the art will appreciate that this is but one fluid system in which the scroll compressor assembly 20 could suitably be utilized, and that application of the scroll compressor assembly 20 in refrigeration and air conditioning systems is to be taken as exemplary rather than as limiting.

The refrigeration system, shown generally in schematic representation in FIG. 2 in connection with the scroll compressor assembly 20, includes a discharge line 54 connected between the shell discharge aperture 50 and a condenser 60 for expelling heat from the refrigeration system and in the process typically condensing the refrigerant from vapor form to liquid form. A line 62 connects the condenser 60 to an expansion device 64. The expansion device 64 may be a thermally actuated or electrically actuated valve operated by a suitable controller (not shown), a capillary tube assembly, or other suitable means of expanding the refrigerant in the system. Another line 66 connects the expansion device 64 to an evaporator 68 for transferring expanded refrigerant from the expansion device 64 to the evaporator 68 for the acceptance of heat and typically the evaporation of the liquid refrigerant to a vapor form. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using suitably a scroll compressor apparatus 20 are well understood in the art, and that further detailed explanations of the devices and mechanisms suitable for constructing such a refrigeration system need not be discussed in detail herein. It is believed that it will also be apparent to those skilled in the art that such refrigeration or air conditioning systems may include multiple units of the compressor assembly 20 in parallel or series type connection, as well as multiple condensers 60, evaporators 68, or other components and enhancements such as subcoolers and cooling fans and so forth as are believed known in the art.

Figure 3A:
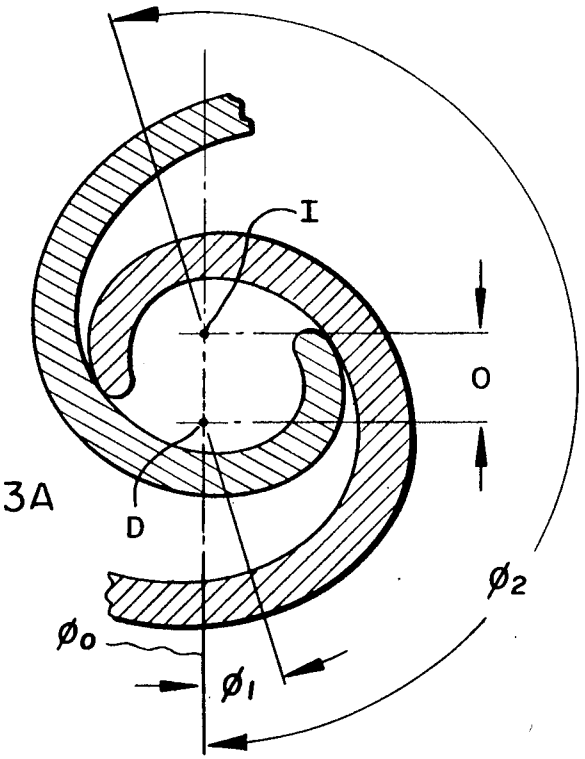
FIG. 3A is an enlarged view of the central portion of FIG. 3 which more clearly illustrates the location and offset of the axis of rotation of the drive and idler scroll members as well as the line of zero crank angle and angles $phi_1$ and $phi_2$ which are defined with respect thereto.
Figure 3:
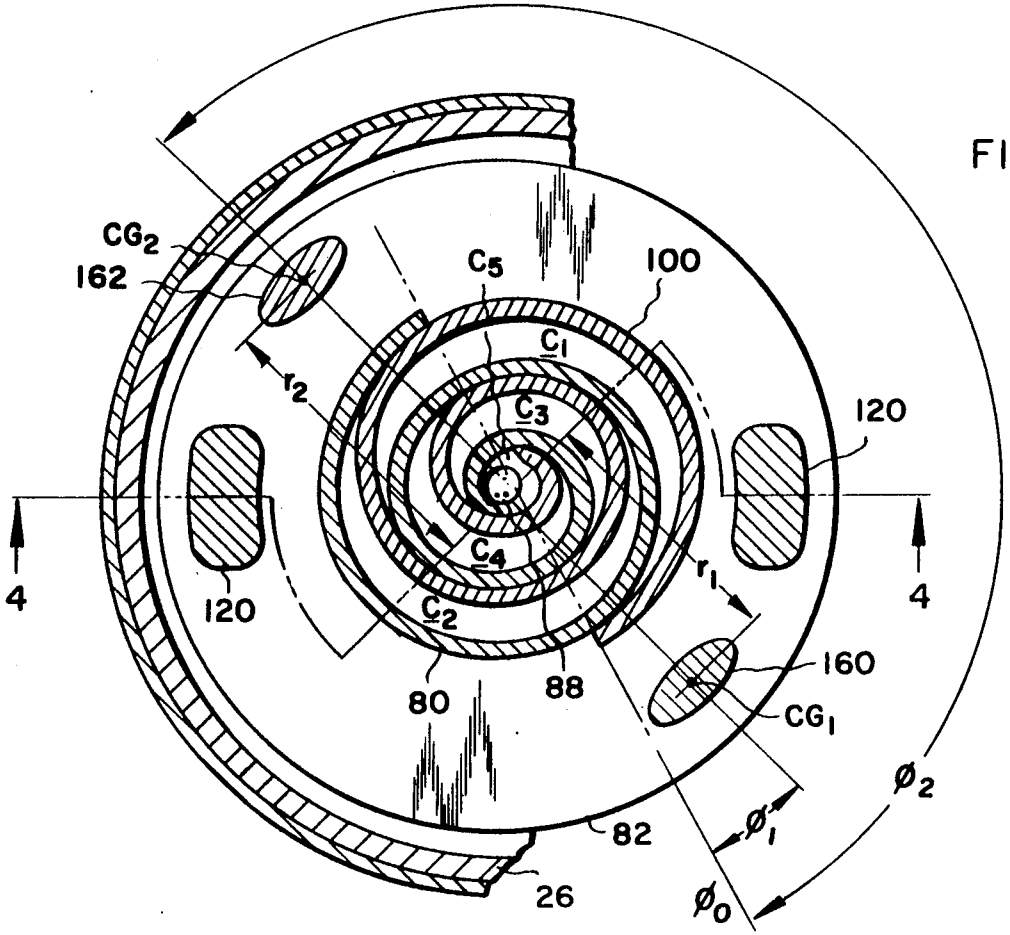
FIG. 3 shows a cross-sectional view of the scroll apparatus of FIG. 1 taken along section lines 3—3.

FIGS. 3 and 3A present cross-sectional views of FIG. 1 which more clearly disclose the subject invention. A dimension 0 defines the offset distance between the axis D and the axis I. A line $phi_0$ is defined through the axis D of the drive scroll member 76 and axis I of the idler scroll member 88. Since these axes are fixed, the line $phi_0$ is also fixed with reference to the scroll apparatus 20 and may in turn be used as a reference line from which the angular disposition of the scroll apparatus components may be referenced. The line $phi_0$ also represents the point of zero crankangle and the point at which the outer ends of the respective scroll wraps 80 and 100 first make contact with the other respective scroll wrap to close the first or outer chamber.

In FIG. 3, an unbalancing or moment reducing mass 160 is applied to the drive scroll member 76, while a second moment producing mass 162 is applied to the idler scroll member 78. As shown, the preferred embodiment of the subject invention employs a mass 160 and 162 applied by such mechanical means as welding or adhesive to the respective scroll member end plate 82 and 102. The masses 160 and 162 comprise means for enhancing the nutational stability of the scroll member to which they are applied, as will be explained below.

The moment producing mass 160 has a center of gravity $cg_1$ which is disposed at a radius $r_1$ from the center of rotation (axis D) of the first scroll member 76 to which it is applied. The mass 160 is angularly disposed at an angle phil from the line $phi_0$. The second moment producing mass 162 has a center of gravity $cg_2$ disposed at a radius $r_2$ from the center of rotation (axis I) of the idler scroll member 78. The second mass 162 is applied to the end plate 102 at an angular disposition defined by angle $phi_2$ from the line $phi_0$ described above.

In the preferred embodiment, the shape of the masses 160 and 162 includes curved surfaces so as to minimize any potential frictional resistance between the masses 160 and 162 and the fluid in which the scroll members 76 and 78 are rotating. It will be appreciated that the shape of the masses 160 and 162 may be varied, and that the masses 160 and 162 may even be formed to act as impeller vanes and thereby assist the inflow of fluid to the scroll wraps 80 and 100 when the scroll apparatus 20 is operated as a compressor. Furthermore, it will be appreciated that the radius r and angle phi for the masses 160 and 162 as shown are purely representative, and not to be taken as limiting. It is likely in many cases that phil and $phi_2$ will be equal or substantially equal and that in many cases it may be desirable to provide only a mass 160 or a mass 162 on only one of the scroll members. It must also be understood that the mass $m_1$ of mass 160 may or may not be substantially equal to the mass $m_2$ of the second mass 162 in a scroll apparatus which includes both the first mass 160 and the second mass 162. The amount of the mass $m_1$ and $m_2$ of the first mass 160 and second mass 162, the radius $r_1$ and $r_2$ by which the masses are removed from the respective axis of rotation, and the radial disposition $phi_1$ and $phi_2$ of the masses must be determined according to each particular case according to the teaching below.

Figure 4:
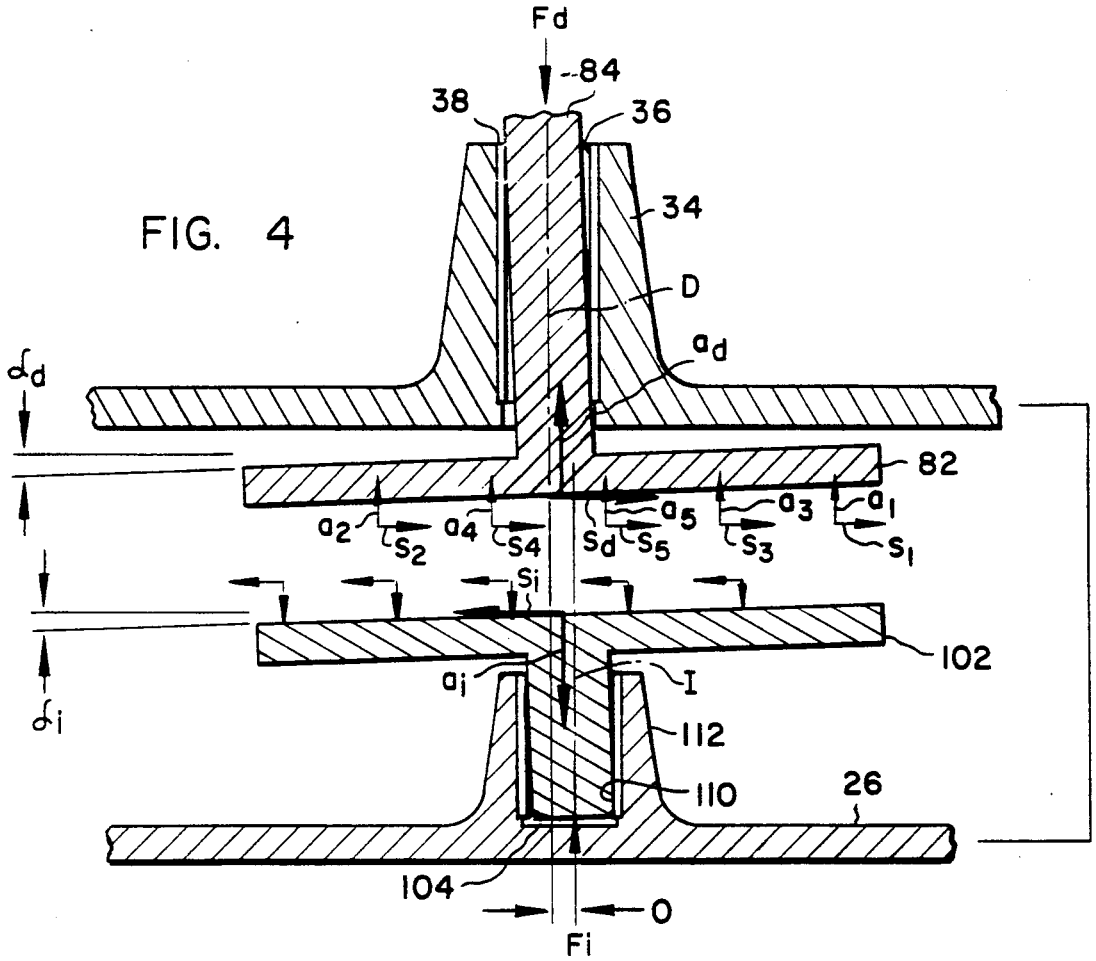
FIG. 4 shows the effect of the tipping moment upon a representative co-rotational scroll apparatus.

FIG. 4 presents a cross-sectional view of the scroll apparatus 20 taken at an angular location at which there are five chambers $C_1$ through $C_5$, as shown in FIG. 3. Each of the chambers generates an axial separating force a and a radial separating force s. For example, chamber $C_1$ would generate force vector $a_1$ as an axial separating force upon the end plate 82 tending to separate the drive scroll end plate 82 from the idler scroll end plate 102, and force vector $s_1$, a radial separation force, would act upon the scroll wrap 80 tending to cause a separation from the second scroll wrap 100. Both force vectors $a_1$ and $s_1$ would tend to cause a turning or tipping of the first scroll member 76 perpendicular to the axis of rotation of the scroll member. The total axial separation force a is equal to the vector sum al plus $a_2$ plus $a_3$ plus $a_4$ plus $a_5$ and the net radial separation force s equals the vector sum $s_1$ plus $s_2$ plus $s_3$ plus $s_4$ plus $s_5$. The net separation force is offset from the axis of rotation of the first scroll member 76. As a result, an instantaneous tipping moment mt is produced. The moment $m_t$ acts upon the scroll member 76 to produce a tipping or nutation shown as angle $delta_d$. Because the chambers are disposed at the same radial and angular location and the fluid forces are the same, but the axes of the scroll members 76 and 78 are offset, the forces in each chamber act to produce a tipping moment $m_t$ for each scroll member 76 and 78. Therefore, the forces in chambers C1 through C5 act to produce a tipping or nutation of the scroll member 78 shown as angle $delta_i$, which may differ from the angle $delta_d$ produced in the scroll member 76 due to differences in the number, types, and sizes of bearing supporting the respective scroll member shafts and other constraints on the respective scroll member end plates. The scroll wraps 80 and 100 will typically separate when $delta_i$ and $delta_d$ differ.

This calculation must be repeated for each angular point of rotation for the respective scroll members 76 and 78. As shown in FIG. 4, an axial biasing force Fd is provided upon the drive scroll member 76 and an axial biasing force Fi is provided upon the idler scroll member 78 by the axial biasing means. The force Fd must be sufficient to exceed the axial separation force $a_d$, and simultaneously must exceed the moment $m_t$ with a moment $M_e$ produced by the product of $(Fd-a_d)$ times the available or effective contact radius of the scroll tips with the opposing scroll end plate, in order to prevent tipping of the scroll member end plate 82 at any given radial position. Where the force $a_d$ exceeds the force $(Fd-a_d)$, due to the tipping moment $m_t$ will occur. Tipping may even occur when the force a is less than the force Fd where either the force Fd or the contact radius is insufficient to provide a counteracting moment. The force Fi is similar in nature.

Figure 5:
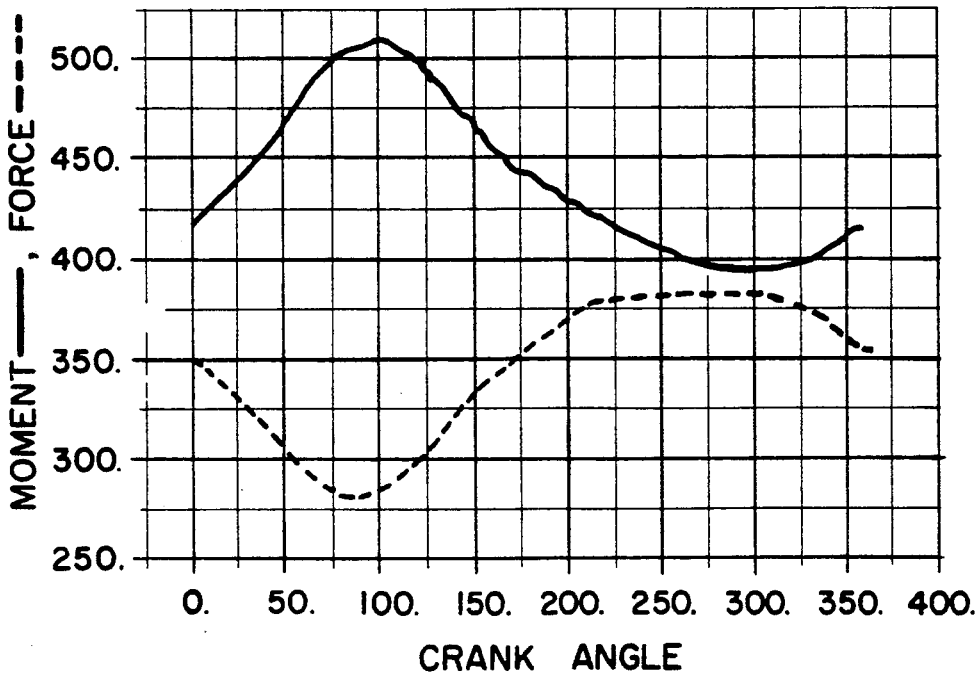
FIG. 5 is a diagram representative of the combined tipping moment and moderating moment, and of the axial scroll tip contact force acting upon one scroll member during the rotation of the scroll member in a co-rotational scroll apparatus.

FIG. 5 shows an analysis of the instantaneous tipping moments acting upon one of the scroll members 76 or 78 during the rotation of the scroll member. Crank angle refers to the angular position of the respective scroll members from the position at which $phi_0$ occurs, being between 0° and 360° (full circle) on the horizontal axis of the diagram, while the vertical axis of the diagram discloses the moment experienced at each radial position and the axial contact force Fd minus $a_d$ at each radial position. The curve representing the instantaneous moment at each radial position is roughly sinusoidal, as is the curve representing the axial contact force.

Figure 6:
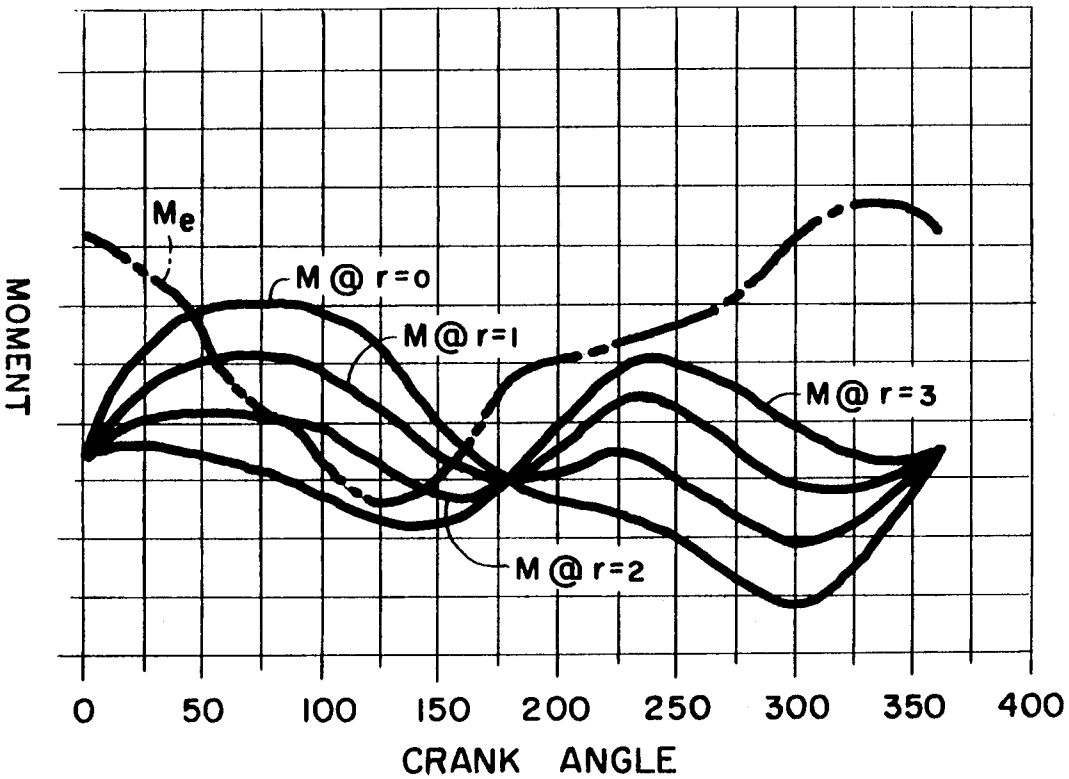
FIG. 6 is a diagram representative of the tipping moment as combined with various moderating moments, acting upon one of the scroll members during the rotation of the scroll members.

FIG. 6 shows the instantaneous moments acting upon one of the scroll members 76 or 78 during the rotation of the scroll members with the Cg of the mass $m_1$ disposed at various radii $r_1$ at a given $phi_1$, or the Cg of the mass $m_2$ disposed at various radii $r_2$ at a given $phi_2$. For simplicity, the subscript is deleted, since the Figure is representative of conditions which may occur in either scroll member 76 or 78. Those radii represented include r=0, r=1 unit, r=2 units and r=3 units, where both phi and mass are constant. As noted above, $M_e$ represents the moment produced by the product of $(F_d\text{-}a_d)$ times the available or effective contact radius of the scroll tips with the opposing scroll end plate.

Those skilled in the art will recognize that specific unit measurements are not given in FIG. 6 since the invention is applicable to scroll apparatus of any size, and further because the FIG. 6 is intended to be representative of the results obtained generally by the application of the mass 160 or 162 to the scroll apparatus and is not therefore to be taken as limited to a specific case. Suitable specific unit measurements would include multiples of tens of inchs or centimeters, and multiples of inches or centimeters.

It will be observed that the graph representing the instanteous moments for r=0 produces the highest maximum moment at those crankangle positions where the available countering moment is minimal. The graph representing the instanteous moments for r=2 produces a lesser maximum moment. When r=3, the lowest maximum moment is produced in the exemplary apparatus at those crankangle positions where the available countering moment is minimal. It will be appreciated that these graphs are illustrative and are by way of example only, rather than limiting, since the actual angle phi and radius r selected for disposition of the moderating mass will vary for each scroll member to which the subject invention is applied, and the actual nutation observed in any scroll apparatus 20 depends upon the actual tipping moment at any angular position versus the available counteracting moment for preventing nutation. However, as exemplified, the radius r=3 is the preferred position for the placement of the moderating means, mass m, since the curve Me is not exceeded at any crankangle position, and the radius r=0 is the least desirable placement.

It will be appreciated that the mass $m_1$ and $m_2$ of masses 160 and 162 creates a mechanical dynamic imbalance of the scroll end plates 82 and 102 which, by the placement of the masses at predetermined locations on the respective end plates, creates a force which acts in opposition to and reduces the maximum tipping moment generated by the fluid forces acting on the scroll end plates 82 and 102. The moderating moment generated by the mass 160 and 162, which acts in opposition to the maximum tipping moment, is additive to the minimum moment of the scroll member generated by the mechanical components of the scroll member. Therefore, it is necessary to select the amount of the mass $m_1$ and $m_2$ of the masses 160 and 162 so that the necessary moderating moment is obtained without adding excessively to the minimum moment of the scroll member.

The method of reducing the moment of the scroll member by providing a moderating moment by mass-induced scroll imbalance includes the following steps: the instantaneous tipping moment acting upon a first scroll is determined for each angular position; the maximum tipping moment together with the angular or crankangle position or range of angular positions at which the maximum tipping moment acts is then determined; a moderating moment required to moderate the first scroll maximum tipping moment is determined, the amount $m_1$ of a first mass 160, an the radius $r_1$ and angular disposition $phi_1$ of such a first mass 160 to induce the desired moderating moment is determined; and the first mass 160 is applied to the first scroll member 82. This first mass 160 may be mechanically applied by welding or other means, or may be made integral with the first scroll member 76 at the time of manufacture. In order to further enhance the nutational stability of both scroll members in the scroll apparatus 20, a mass 162 may be applied to the second scroll member 78 by a method comprised simply of repeating the steps utilized to determine the mass and disposition of the mass 160 for the first scroll member 76.

Those skilled in the art will recognize that the use of the mass induced moment for enhancing the nutational stability of the co-rotating scroll apparatus 20 represents a substantial improvement in the art. The mass 160 and 162 may be determined by analytical methods, and involve no moving parts which require additional maintenance and increase the initial expense of the compressor assembly 20. Furthermore, the use of the masses 160 and 162, which creates a purposeful dynamic imbalance in their respective scroll members the effect of which is to create a tipping force which acts in opposition to the maximum tipping moments to which their respective scroll members would otherwise be subject to in operation, reduces the overall axial biasing force which must be applied to the scroll members to ensure that they do not separate, at any rotational position, as a result of the gas compression forces which exist therebetween in operation. This in turn reduces the frictional losses between the tip scroll wraps 80 and 100 and the end plates 82 and 102, respectively, which in turn reduces the power consumption of the scroll apparatus 20 for a given capacity, permitting the use of smaller and lighter motors 40. In all respects, therefore, the subject invention represents a substantial improvement which reduces the initial cost and improves the overall efficiency of the scroll apparatus 20. Furthermore, although the subject invention is exemplified in a scroll apparatus 20 useful in refrigeration system applications, it will be undoubtedly appreciated that the subject invention is useful in all applications of the co-rotational scroll apparatus 20, including pumps, expanders, fluid driven engines, and other applications, with like improvement in performance and reduction of expense.

Modifications to the preferred and alternate embodiments of the subject invention will be apparent to those skilled in the art within the scope of the claims that follow hereinbelow.

What is claimed is:

1. A scroll apparatus comprised of:

a first scroll member having a first scroll and plate and a first upstanding involute portion disposed on said first scroll end plate;

a second scroll member having a second upstanding involute portion disposed thereon in interleaving engagement with said involute of said first scroll member;

means for creating a dynamic imbalance in one of said scroll members the result of which is to enhance the nutational stability of said one scroll member by creating a force which acts in opposition to and reduces the maximum tipping moment to which said one scroll member is subject in operation; and means for rotating said first and second scroll members.

2. The scroll apparatus as set forth in claim 1 wherein said scroll apparatus is further comprised of means for creating a dynamic imbalance in the scroll member other than said one of said scroll members to the result of which is to enhance the nutational stability of the other one of said scroll members by creating a force which acts in opposition to and reduces the maximum tipping moment to which said other scroll member is subject in operation.

3. A co-rotational scroll apparatus comprised of:

a first scroll member having a first scroll end plate, a first upstanding involute portion disposed on said first scroll end plate and a drive shaft disposed on said end plate, said first scroll member being subject to a tipping moment in operation;

a second scroll member having a second scroll end plate, a second upstanding involute portion disposed on said second scroll end plate and an idler shaft disposed on said second end plate;

a moderating moment producing mass, applied to said first scroll member, for creating a dynamic imbalance in said first scroll member the effect of which, in operation, is to enhance the nutational stability of said first scroll member by reducing said tipping moment; and means for rotating said first scroll member and said second scroll member.

4. The scroll apparatus as set forth in claim 3 wherein said moment producing mass is disposed at a predetermined angle from a line of zero crank angle.

5. The scroll apparatus as set forth in claim 4 wherein said moment producing mass is disposed at a predetermined distance from the axis of rotation of the first scroll member.

6. The scroll apparatus as set forth in claim 5 wherein said moment producing mass is mechanically applied to said first scroll end plate.

7. The scroll apparatus as set forth in claim 5 wherein said moment producing mass is integral to said first scroll end plate.

8. The scroll apparatus as set forth in claim 5 wherein said scroll apparatus includes a second moderating moment producing mass applied to said second scroll member, said second moderating moment producing mass creating a dynamic imbalance in said second scroll member the effect, in operation, of which is to enhance the nutational stability of said second scroll member.

9. The scroll apparatus as set forth in claim 8 wherein said second moment producing mass is disposed at a predetermined angle from said line of zero crank angle.

10. The scroll apparatus as set forth in claim 9 wherein said second moment producing mass is disposed at a predetermined distance from the axis of rotation of the second scroll member.

11. The scroll apparatus as est forth in claim 10 wherein said second moment producing mass is mechanically applied to said second scroll end plate.

12. The scroll apparatus as set forth in claim 10 wherein said second moment producing mass is integral to said second scroll end plate.

13. A co-rotational scroll apparatus comprised of:

a hermetic shell having a suction pressure portion;

a first scroll member disposed in said suction pressure portion, said first scroll member having a first scroll end plate, a first upstanding involute disposed on said first scroll end plate and a drive shaft extending from said first end plate;

a first mass disposed on said first scroll member, said first mass creating a dynamic imbalance in said first scroll member which, in operation, generates a moderating moment which reduces the maximum tipping moment said first scroll member is subject to when said apparatus is in operation;

a second scroll member disposed in said suction pressure portion, said second scroll member having a second scroll end plate, a second upstanding involute disposed on said second scroll end plate and an idler shaft extending from said second end plate, said idler shaft having an axis parallel to but offset from the axis of said first scroll member drive shaft;

a second mass disposed on said second scroll member, said second mass creating a dynamic imbalance in said second scroll member which, in operation, generates a moderating moment which reduces the maximum tipping moment said second scroll member is subject to when said apparatus is in operation;

means for concurrently rotating said first scroll member and said second scroll member.

14. The scroll apparatus as set forth in claim 13 wherein said first mass is disposed at a predetermined distance from the axis of said first scroll member drive shaft.

15. The scroll apparatus as set forth in claim 14 wherein said first mass is disposed on said first scroll end plate at a predetermined angle from a line of zero crank angle.

16. The scroll apparatus as set forth in claim 15 wherein said first mass is mechanically applied to said first scroll end plate.

17. The scroll apparatus as set forth in claim 15 wherein said first mass is integral to said first scroll end plate.

18. The scroll apparatus as set forth in claim 13 wherein said second mass is disposed at a predetermined distance from said axis of said idler shaft.

19. The scroll apparatus as set forth in claim 18 wherein said second mass is disposed on said second scroll end plate at a predetermined angle from a line of zero crank angle.

20. The scroll apparatus as set forth in claim 19 wherein said second mass is mechanically applied to said second scroll end plate.

21. The scroll apparatus as set forth in claim 19 wherein said second mass is integral to said second scroll end plate.

22. The scroll apparatus as set forth in claim 13 wherein said first mass is disposed at a predetermined distance from the axis of said first scroll member drive shaft and at a predetermined angle from a line of zero crank angle and wherein said second mass is disposed at a predetermined distance from the axis of said idler shaft and at a second predetermined angle from said line of zero crank angle.

23. The scroll apparatus as set forth in claim 22 wherein said hermetic shell further comprises a central frame having an aperture defined therethrough, said hermetic shell further including means for rotatably supporting said drive shaft in said aperture and a lower bearing housing in said suction portion.

24. The scroll apparatus as set forth in claim 23 wherein said hermetic shell further includes means for rotatably supporting said idler shaft in said lower bearing housing.

25. The scroll apparatus as set forth in claim 24 wherein said means for driveably rotating said drive shaft is a motor.

26. A co-rotational scroll apparatus for compressing a fluid from a suction pressure to a relatively higher discharge pressure, said scroll apparatus comprised of:

a hermetic shell having a suction pressure portion, a discharge pressure portion and a central frame therebetween, said central frame defining a drive shaft aperture;

a first scroll member disposed in said suction pressure portion, said first scroll member having an axis of rotation, a first scroll end plate, a first upstanding involute portion disposed on said end plate and a drive shaft extending from said first end plate, said drive shaft extending rotatably through said drive shaft aperture of said central frame;

a second scroll member disposed in said suction pressure portion, said second scroll member having an axis of rotation parallel to but offset from the axis of rotation of said first scroll member, the axes of rotation of said first and said second scroll members cooperatively defining a line of zero crank angle, said second scroll member further having a second scroll end plate, a second upstanding involute portion disposed on said end plate and an idler shaft extending from said second end plate;

a mass applied to said first scroll end plate at a predetermined angle from said line of zero crank angle, said first mass creating a dynamic imbalance in said first scroll member which generates a moderating moment in operation, said moderating moment acting in opposition to and reducing the maximum tipping moment to which said first scroll member is subject in operation, said first mass having a center of gravity disposed at a predetermined distance from the axis of rotation of said first scroll member;

means for rotatably supporting said drive shaft;

means for rotatably supporting said idler shaft;

a motor for driveably rotating said drive shaft of said first scroll member, said motor disposed in said discharge pressure portion of said apparatus; and means for concurrently rotating said first scroll member and said second scroll member so as to create relative orbital motion therebetween.

27. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and sending the refrigerant to the condenser, said compressor including:

i. a first scroll member having a first axis of rotation, a first scroll end plate, a first upstanding involute portion disposed on said end plate and a drive shaft extending from said end plate, said first scroll member being subject to a tipping moment in operation;

ii. a second scroll member having a second axis of rotation, said second axis of rotation cooperatively defining a line of zero crank angle with said first axis of rotation, a second scroll end plate, a second upstanding involute portion disposed on said second scroll end plate and an idler shaft extending from said second scroll end plate, said second scroll member being subject to a tipping moment in operation;

iii. a moderating moment producing mass applied to one of said first and said second scroll members for moderating the tipping moment and enhancing the nutational stability of said one scroll member by causing a dynamic imbalance in said one scroll member which in turn results in the creation of a force that acts in opposition to and reduces the tipping moment said one scroll member is subject to when said compressor is in operation; and iv. means for rotating said first and second scroll members.

28. The refrigeration system as set forth in claim 27 wherein said moment producing mass is disposed at a predetermined angle from said line of zero crank angle.

29. The refrigeration system as set forth in claim 28 wherein said moment producing mass is disposed at a predetermined distance from the axis of rotation of said one scroll member.

30. The refrigeration system as set forth in claim 29 wherein said moment producing mass is mechanically applied to said one scroll member end plate.

31. The refrigeration system as set forth in claim 29 wherein said moment producing mass is integral to said one scroll member end plate.

32. The refrigeration system as set forth in claim 29 wherein said compressor includes a second moderating moment producing mass applied to the other one of said scroll members for reducing the tipping moment and enhancing the nutational stability of said other scroll member.

33. The refrigeration system as set forth in claim 32 wherein said second moment producing mass is a predetermined angle from said line of zero crank angle.

34. The refrigeration system as set forth in claim 33 wherein said second moment producing mass is disposed at a predetermined distance from the axis of rotation of the other scroll member.

35. The refrigeration system as set forth in claim 34 wherein said second moment producing mass is mechanically applied to said other scroll end plate.

36. The refrigeration system as set forth in claim 34 wherein said second moment producing mass is integral to said other scroll end plate.

37. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a co-rotational scroll compressor for receiving the refrigerant from the evaporator, compressing the refrigerant and sending the refrigerant to the condenser, said co-rotational scroll compressor having:

i. a hermetic shell having a suction pressure portion, a discharge pressure portion and a central frame therebetween, said central frame defining a drive shaft aperture;

ii. a first scroll member disposed in said suction pressure portion, said first scroll member having a first axis of rotation, a first scroll end plate, a first upstanding involute portion disposed on said first scroll end plate and a drive shaft extending from said first scroll end plate, said drive shaft extending rotatably through the drive shaft aperture of said central frame;

iii. a second scroll member disposed in said suction pressure portion, said second scroll member having a second axis of rotation for cooperatively defining a reference line with the first axis of rotation, said second scroll member having a second scroll end plate, a second upstanding involute portion disposed on said second scroll end plate and an idler shaft extending from said second end plate;

iv. a first mass applied to said first scroll end plate at a predetermined angle from said reference line, said first mass creating a dynamic imbalance in said first scroll member that produces, in operation, a first moderating moment which acts in opposition to and reduces the maximum tipping moment experienced by said first scroll member, said first mass having a center of gravity disposed at a predetermined distance from said first axis of rotation;

v. a second mass applied to said second scroll end plate at a second predetermined angle from said reference line said second mass creating a dynamic imbalance in said second scroll member that produces, in operation, a second moderating moment which acts in opposition to and reduces the maximum tipping moment experienced by said second scroll member, said second mass having a center of gravity at a predetermined radius from said second axis of rotation;

vi. means for rotatably supporting said drive shaft in said drive shaft aperture of said central frame;

vii. means for rotatably supporting said idler shaft in said suction portion of said hermetic shell;

viii. a motor for driveably rotating said drive shaft of said first scroll member; and ix. means for concurrently rotating said first scroll member and said second scroll member so as to cause relative orbital motion therebetween.

38. A method of enhancing nutational stability of a co-rotational scroll apparatus having a first scroll member rotating about a first axis and a second scroll member in interleaving engagement with said first scroll member rotating about a second axis, said first and second axes defining a reference line, said method comprised of the step of applying a first mass to said first scroll member at an angular disposition from said reference line and at a predetermined distance from said first axis so as to create a dynamic imbalance in said first scroll member, the effect of said dynamic imbalance, in operation, being to reduce the maximum tipping moment to which said first scroll member is subjected when said scroll apparatus is in operation.

39. The method as set forth in claim 38 wherein said method comprises the further step of applying a second mass to said second scroll member at an angular disposition from said reference line and a radius from said second axis of said second scroll member.

40. A method of enhancing the nutational stability of a co-rotational scroll apparatus having a first scroll member rotating about a first axis and a second scroll member in interleaving engagement with said first scroll member rotating about a second axis, said first and second axes defining a reference line, said method comprising the steps of:

determining the maximum tipping moment acting upon said first scroll member and the angular position, with respect to said reference line, of said first scroll member with respect to said reference line at which said maximum tipping moment occurs; and applying a mass to said first scroll member at a predetermined location to dynamically imbalance said first scroll member, the effect of said imbalance being to create a force, when said apparatus is in operation, which acts in opposition to and reduces said maximum tipping moment.

41. The method of enhancing nutational stability in a co-rotational scroll apparatus as set forth in claim 40 comprising the further steps of:

determining the maximum tipping moment to which said second scroll member is subject in operation and the angular position, with respect to said reference line, of said second scroll member at which said second scroll member maximum tipping moment occurs; and applying a mass to said second scroll member at a predetermined location to create a dynamic imbalance in said second scroll member, said dynamic imbalance resulting in the creation of force, when said apparatus is in operation, which acts in opposition to and reduces the maximum tipping moment to which said second scroll member is subjected in operation.

* * * * *

UNITED STATES PATENT AND TRADEMARK OFFICE

CERTIFICATE OF CORRECTION

PATENT NO. : 5,142,885

DATED : September 1, 1992

INVENTOR(S) : Robert E. Utter and Daniel R. Crum

It is certified that error appears in the above-identified patent and that said Letters Patent is hereby corrected as shown below:

Column 7, Line 19, "88" should read --78--.

Column 7, Line 42 "phil" should read --$phi_1$--.

Column 7, Line 61, "phil" should read --$phi_1$--.

Claim 1, Column 10, Line 60, "and" should read --end--.

Claim 2, Column 11, Line 10, delete the word "to".

Claim 11, Column 11, Line 61, "as est" should read --as set--.

Signed and Sealed this

Seventh Day of September, 1993

Bruce Lehman

*Attest:*

BRUCE LEHMAN

*Attesting Officer*

*Commissioner of Patents and Trademarks*